US010942539B2

(12) United States Patent
Hettegger et al.

(10) Patent No.: US 10,942,539 B2
(45) Date of Patent: Mar. 9, 2021

(54) METHOD FOR CONTROLLING A WORK MACHINE

(71) Applicant: LIEBHERR-WERK BISCHOFSHOFEN GMBH, Bischofshofen (AT)

(72) Inventors: Mario Hettegger, Grossarl (AT); Manuel Bos, Hallein (AT); Hans Knapp, Bischofshofen (AT); Christoph Kiegerl, Werfenweng (AT)

(73) Assignee: LIEBHERR-WERK BISCHOFSHOFEN GMBH, Bischofshofen (AT)

( * ) Notice: Subject to any disclaimer, the term of this patent is extended or adjusted under 35 U.S.C. 154(b) by 344 days.

(21) Appl. No.: 16/099,696

(22) PCT Filed: May 11, 2017

(86) PCT No.: PCT/EP2017/000579
§ 371 (c)(1),
(2) Date: Nov. 8, 2018

(87) PCT Pub. No.: WO2017/194192
PCT Pub. Date: Nov. 16, 2017

(65) Prior Publication Data

US 2019/0187742 A1 Jun. 20, 2019

(30) Foreign Application Priority Data

May 13, 2016 (DE) ..... 10 2016 005 984.2
Dec. 20, 2016 (DE) ..... 10 2016 015 155.2

(51) Int. Cl.
*G05G 5/05* (2006.01)
*G05G 5/03* (2008.04)
(Continued)

(52) U.S. Cl.
CPC ..... *G05G 5/05* (2013.01); *G05G 1/08* (2013.01); *G05G 5/03* (2013.01); *G05G 9/047* (2013.01); *G05G 1/04* (2013.01)

(58) Field of Classification Search
None
See application file for complete search history.

(56) References Cited

U.S. PATENT DOCUMENTS 4,477,043 A * 10/1984 Repperger ..... G05G 9/047 244/223
4,543,842 A * 10/1985 Katayama ..... B60K 20/04 267/150

(Continued)

FOREIGN PATENT DOCUMENTS

DE 112014000302 T5 9/2015
EP 0145684 A2 6/1985
JP 3065603 B1 7/2000

OTHER PUBLICATIONS

Search Report issued in corresponding German Patent Application No. 10 2016 015 1552 dated Dec. 21, 2017 (7 pages).

(Continued)

*Primary Examiner* — William Kelleher
*Assistant Examiner* — Gregory T Prather
(74) *Attorney, Agent, or Firm* — Kilyk & Bowersox, PLLC

(57) ABSTRACT

The invention relates to a system for controlling a work machine, in particular a wheel loader, having at least one hand-held control device (6), in particular a joystick or steering wheel, at least one restoring device (8) in the form of one or more spring assemblies, which are connected to the hand-held control device in such a way a restoring force is exerted upon the hand-held control device by the spring assembly when said spring assembly is not in the central position. An adjusting device (9, 12, 13) which engages with (Continued)

Figure 1:
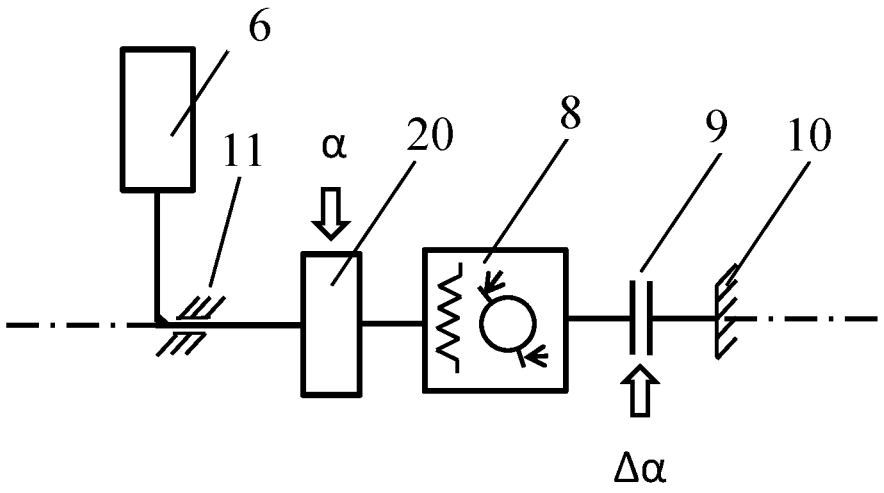

the spring assembly such that an adjustment of the central position of the spring assembly can be carried out, is provided.

20 Claims, 5 Drawing Sheets

(51) Int. Cl.
*G05G 1/08* (2006.01)
*G05G 9/047* (2006.01)
*G05G 1/04* (2006.01)

(56) References Cited

U.S. PATENT DOCUMENTS 4,662,238 A * 5/1987 Zeller ..... B62D 1/04 29/894.1
4,696,445 A * 9/1987 Wright ..... B64C 13/0421 244/229
5,335,743 A * 8/1994 Gillbrand ..... B60K 20/02 180/170
5,560,253 A * 10/1996 Ishikawa ..... B60K 20/04 403/330
5,893,429 A * 4/1999 Hackl ..... B60R 25/02 180/417
5,911,787 A * 6/1999 Walker ..... F16H 61/702 701/51
6,145,398 A * 11/2000 Bansbach ..... F16H 61/2807 477/76
6,460,640 B1 * 10/2002 Keagle ..... A01B 51/02 180/19.3
6,641,085 B1 * 11/2003 Delea ..... B64C 25/505 244/50
8,066,567 B2 * 11/2011 Waggoner ..... G06F 3/016 463/38
8,186,239 B2 * 5/2012 Wakitani ..... G05G 5/05 74/471 XY
8,666,601 B1 * 3/2014 Van Wiemeersch ..... B62D 15/0285 701/41
9,637,163 B2 * 5/2017 Mayer ..... G05G 5/05
10,647,344 B1 * 5/2020 Rafferty ..... B60R 16/027
2001/0052893 A1 * 12/2001 Jolly ..... B62D 5/006 345/156
2006/0054377 A1 * 3/2006 Izukura ..... F16H 59/06 180/307
2006/0236799 A1 * 10/2006 Hedman ..... F16H 61/30 74/335
2006/0236800 A1 * 10/2006 Yone ..... F16H 61/24 74/336 R
2008/0023250 A1 * 1/2008 Hefner ..... G05G 1/08 180/332
2010/0218639 A1 * 9/2010 Kramlich ..... G05G 1/087 74/504
2010/0302017 A1 * 12/2010 Guglielmo ..... B66F 11/04 340/407.2
2011/0005344 A1 * 1/2011 Haevescher ..... F16H 61/24 74/473.12
2013/0166154 A1 * 6/2013 Kohara ..... B62D 1/181 701/49
2013/0229272 A1 * 9/2013 Elliott ..... G05G 9/047 340/407.2
2014/0069221 A1 * 3/2014 Ishida ..... F16H 61/16 74/473.22
2014/0214278 A1 * 7/2014 Kuipers ..... G05B 13/00 701/42
2014/0373661 A1 * 12/2014 Benson ..... F16H 61/18 74/473.21
2015/0198238 A1 * 7/2015 Smith ..... F16H 59/04 74/473.1
2016/0224114 A1 * 8/2016 Vanhelle ..... B60K 37/06
2016/0334830 A1 * 11/2016 Sirohiwala ..... H01F 7/021
2017/0227980 A1 * 8/2017 Hafez ..... H01H 19/00
2018/0003297 A1 * 1/2018 Ma ..... F16H 59/54
2018/0058039 A1 * 3/2018 Fredrickson ..... E02F 9/2012
2019/0179356 A1 * 6/2019 Goto ..... G05G 5/03
2019/0210854 A1 * 7/2019 Eck ..... B66F 17/006
2019/0286237 A1 * 9/2019 Eck ..... G05G 5/03
2019/0294248 A1 * 9/2019 Leroy ..... G06F 3/0362
2020/0125132 A1 * 4/2020 Wakuda ..... G05G 5/02
2020/0142439 A1 * 5/2020 Haevescher ..... G05G 1/08
2020/0174512 A1 * 6/2020 Battlogg ..... B60K 37/00
2020/0215908 A1 * 7/2020 Petrzik ..... B60R 16/005
2020/0272193 A1 * 8/2020 Battlogg ..... F16F 9/535
2020/0326746 A1 * 10/2020 Koike ..... G05G 5/26

OTHER PUBLICATIONS

International Search Report and Written Opinion (with English translation of International Search Report) issued in corresponding International Patent Application No. PCT/EP2017/000579 dated Dec. 6, 2017 (15 pages).

* cited by examiner

METHOD FOR CONTROLLING A WORK MACHINE

This application is a National Stage Application of PCT/EP2017/000579, filed May 11, 2017, which claims priority to German Patent Application No. 10 2016 015 155.2, filed Dec. 20, 2016 and German Patent Application No. 10 2016 005 984.2, filed May 13, 2016.

The present invention relates to an arrangement for controlling a work machine, in particular a wheeled loader, having at least one manual control device that is in particular configured as a joystick or as a steering wheel, having at least one restoring device in the form of one or more spring assemblies that are connected to the manual control device such that a restoring force is exerted on the manual control device by the spring assembly when the spring assembly is not in its central position.

It is known from the prior art to provide a feedback to the manual control device that is perceptible for the user for the control capability of drives of steering mechanisms or attachments such as buckets etc. when the manual operation specification and the reactions at the actuators such as at the hydraulic cylinders differ from one another or do not agree. This can occur, for example, if the bucket of a work machine starts to slow down in the excavated material due to loads that are too large and can no longer follow the operating lever specification. In this case, the restoring force at the operating lever can be increased for the control of the attachment. It is thus drawn to the attention of the user that an overload situation is present, i.e. the bucket can no longer follow the excursion of the operating lever.

This case is naturally not restricted to the actuation of work tools, but can also occur, for example, with a steering mechanism. It is also conceivable here to increase the restoring force on a manual control device such as on a steering wheel or on a joystick or to fully suppress the movement when the steering of the work machine can no longer follow the excursion, rotation, etc. of the work machine.

DE 11 2014 000 302 T5 describes a design for a force feedback in which an electric drive replaces the known spring mechanism, which can in particular be of benefit for steering mechanisms of wheeled loaders and graders. This concept makes very high demands on the steering safety since it has to be precluded that the electric drive brings about an unwanted lever excursion due to a control error that could in turn have the consequence of an unwanted steering movement, which can lead to a hazardous situation. A braking device for an operating lever, in particular having a magnetic powder brake, is known from U.S. Pat. No. 8,066,567 B2. This principle is known from the field of large tractors in the application sector of electrical steering wheels and "steer by wire" steering mechanisms. Due to the lack of elasticity in the structure, the risk arises in this concept of "stick-slip" effects on the closing and opening of the brake, which is expressed by jerking and irregular movements at the manual control device and that in the further procedure exerts unwanted and unusable effects on the control behavior of the drives.

Figure 10:
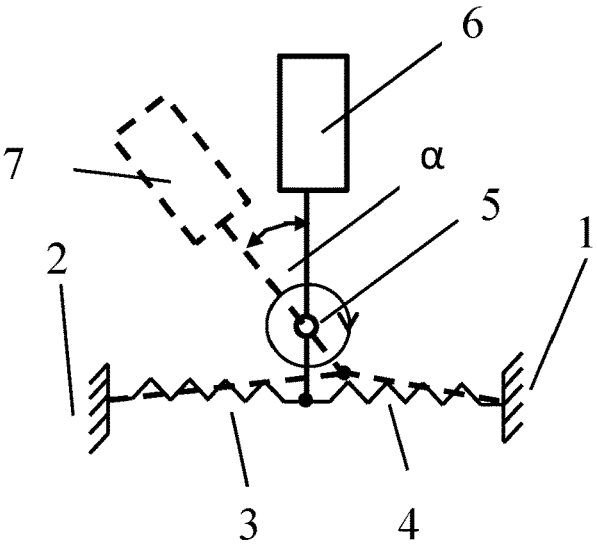

FIG. 10 shows the classical spring restoration mechanism known from the prior art with a joystick 6 in the starting position and in the position in which the joystick has been traveled by the angle $\alpha$ (item 7). The joystick 6 is rotatable about the center of rotation or axis of rotation 5.

Reference numerals 3, 4 show two spring elements that extend at both sides of the joystick and apply a spring force to it in opposite directions depending on the excursion. In the embodiment shown, the joystick 6 is pivoted counterclockwise, which has the consequence that the spring 3 is extended and the spring 4 is compressed. The spring 3 thus exerts a restoring force on the joystick that increases, the greater the angle of the excursion is. The one ends of the springs 3, 4 are arranged at the joystick or at a linkage connected thereto.

Reference numerals 1, 2 are fixed bearing points at which the other ends of the springs are fixed.

Figure 8:
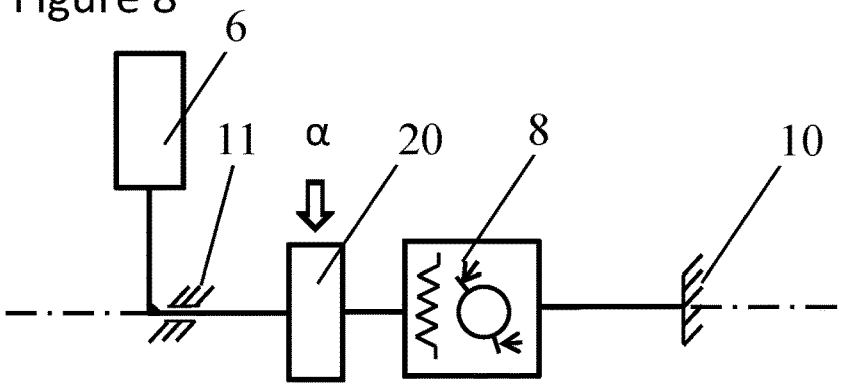

FIG. 8 shows the arrangement in accordance with FIG. 10 from the side, with the sensor 20 additionally being drawn in FIG. 8 that measures the excursion of the joystick, i.e. the angle $\alpha$. Reference numeral 8 designates the spring assembly that, for example, consists of two springs, optionally having a damping element, and reference numerals 10, 11 designate bearing points for the joystick bar that experiences a rotational movement on the excursion of the joystick.

Figure 9:
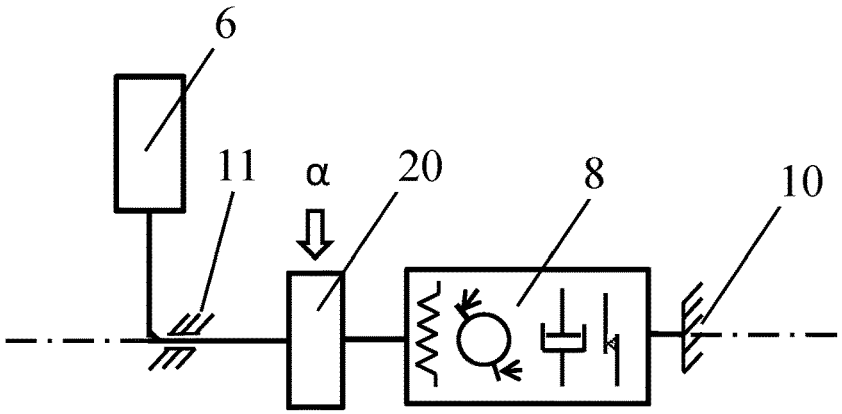

FIG. 9 illustrates an embodiment similar to FIG. 8. It differs from the embodiment in accordance with FIG. 8 in that a friction element is also designated with the reference numeral 8 in addition to the spring assembly and a damping element.

It is the underlying object of the present invention to further develop an arrangement of the initially named kind such that the above-named irregular movements at the manual control device can be avoided such that unwanted effects on the control behavior of the drives do not occur.

This object is achieved by an arrangement having the features of claim 1.

Provision is accordingly made that the arrangement has at least one adjustment device that acts on the spring assembly such that a shifting of the central position of the spring assembly can be carried out by means of the adjustment device.

In accordance with the invention, the spring restoration mechanism known from the prior art is thus maintained, but a shift of the zero point of the spring characteristic within the sensor measurement range can be achieved by the shifting of the spring assembly.

It is pointed out at this point that the term "spring assembly" is to be understood broadly and as any arrangement having exactly one spring or having two or more springs, and arrangements that have one or more further elements such as dampers or friction elements in addition to the at least one spring.

The "central position of the spring assembly" is understood as the position of the spring assembly in which the spring characteristic passes through the zero point, i.e. the manual control device is in a "neutral position" in which it does not experience any resulting restoring force by the spring assembly.

Provision is made in a preferred embodiment of the invention that at least one self-inhibiting transmission, that is preferably configured as a worm gear, is located between the spring assembly and the adjustment device.

It is conceivable that the adjustment device is configured such that the reference value for the shifting of the central position of the spring assembly is formed by the locational change of at least one part moved by the steering actuator of the work machine or by the locational change of the at least one steering actuator itself.

The part can, for example, be the steering geometry and in particular the location or the position of one or more parts of the steering mechanism of the work machine.

The adjustment device serving the shifting of the spring assembly can be active or passive. An active adjustment device is to be understood as an adjustment device having at least one drive element. Such a drive element is lacking in a passive adjustment device; the shifting of the spring assembly is there rather effected by the user himself, i.e. by the movement of the manual control device.

The manual control device can, for example, be a steering wheel, a joystick, a lever, or any other control element to be actuated by a user. It can be used to control or to regulate any desired functionality such as the movement of an attachment, e.g. a bucket, the steering mechanism, or other elements of the work machine.

As stated, the adjustment device can be designed as passive, with the shifting of the central position of the spring assembly taking place by the manual actuation of the manual control device. In this case, the spring assembly is "taken along" by the manual actuation of the manual control device, i.e. by the operator.

It is also conceivable that the adjustment device is designed as active, with the shifting of the central position taking place by at least one adjustment drive, in particular by at least one motor such as at least one electric motor, optionally with a transmission.

The adjustment drive can be configured to fix the spring assembly in the shifted position, which brings about the advantage that no separate braking element is required to hold the spring assembly in its shifted position.

The arrangement can have at least one brake, in particular a magnetic powder brake, and/or at least one coupling that is configured to fix the spring assembly in the shifted position. The spring assembly can thus be held fast by a coupling or brake on a reaching of the new destination central position.

In the case of a use of a drive, the drive can hold the spring assembly fast in the destination central position. The drive can also autonomously shift the spring assembly without any intervention of the operator.

At least one sensor is preferably present that detects the position of the manual control device or a value based thereon such as the excursion of a joystick or the angle of rotation of a steering wheel.

The deflections of the spring assembly can comprise the total measurement range of the sensor or the deflections of the spring assembly can be bounded by one or more abutments, with the abutments preferably being selected such that the travel of the manual control device is possible symmetrically toward both abutments, starting from the central position, but an asymmetrical design is also conceivable and is also covered.

As stated above, the spring assembly can have one or more springs and optionally one or more dampers and/or one or more friction elements.

The steering capability of the work machine is in principle also ensured when an erroneous actuation of the adjustment device and thus an erroneous tracking of the spring assembly are present. This is due to the fact that the respective deflection can e.g. also be traveled by actuating the joystick without any tracking or with an incorrectly locked tracking. A steering in both directions is thus possible.

To ensure that this also applies when the tracking of the spring assembly has run through the maximum deflection, provision is made in accordance with a further embodiment of the invention that the adjustment means are configured such that the spring assembly is designed such that on an adopting of a maximum position of the spring assembly or of its adjustment device, a travel of the manual control device beyond this is possible by the user of the work machine.

A carrying out of steering movements is thus also possible in both directions, i.e. to the right and to the left, at a maximum position of the spring assembly or its adjustment device, i.e. the steering capability of the work machine is maintained even when the spring assembly or its adjustment device has erroneously adopted a maximum position and possibly remains there. This is achieved by a correction angle, i.e. by the possibility of traveling the manual control device beyond this maximum position of the adjustment device of the spring assembly by the degree of the spring excursion.

It is conceivable here that the travel of the manual control device in a maximum position of the spring assembly or of its adjustment device is symmetrical relative to its central position. In this case, the manual control device and thus the steering mechanism can be traveled or actuated to the same degree in both directions.

It is, however, also conceivable that the spring assembly is configured such that the travel of the manual control device is asymmetrical in a maximum position of the spring assembly relative to its central position, with this residual travel beyond the maximum position being smaller than in the opposite direction. The residual deflection, that would not have the consequence of any steering movement in problem-free operation, can thus be kept small.

The arrangement is preferably configured such that the travel of the manual control device is only possible within a sensor range of the arrangement.

If the tracking of the spring assembly is defective in that it takes on a life of its own, for example, provision is made that no change of the travel or no adjustment of the manual control device or excursion of the spring assembly results on this movement of the tracking so that a steering movement of the work machine does not take place.

The present invention further relates to a work machine, in particular to a wheeled loader, that is designed with at least one arrangement in accordance with one of the claims 1 to 16. This arrangement can, for example, serve the control or steering or also the controlling of the work tool.

Figure 2:
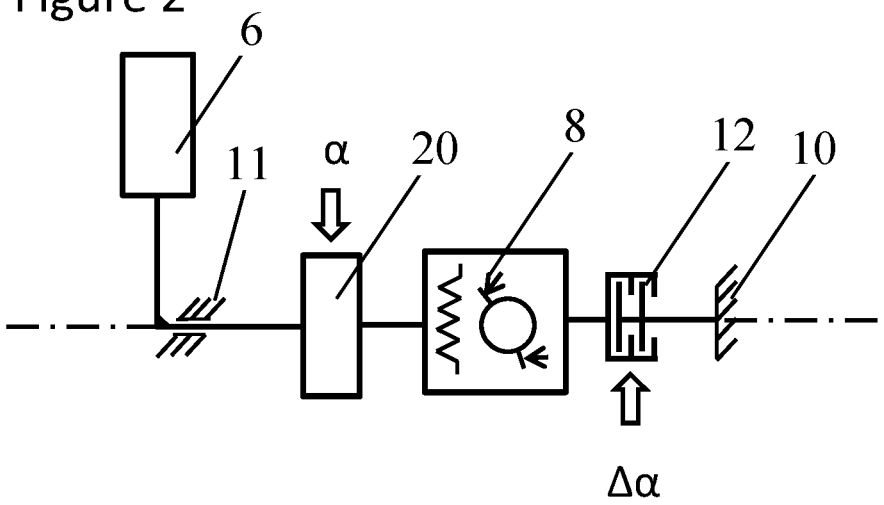
Figure 3:
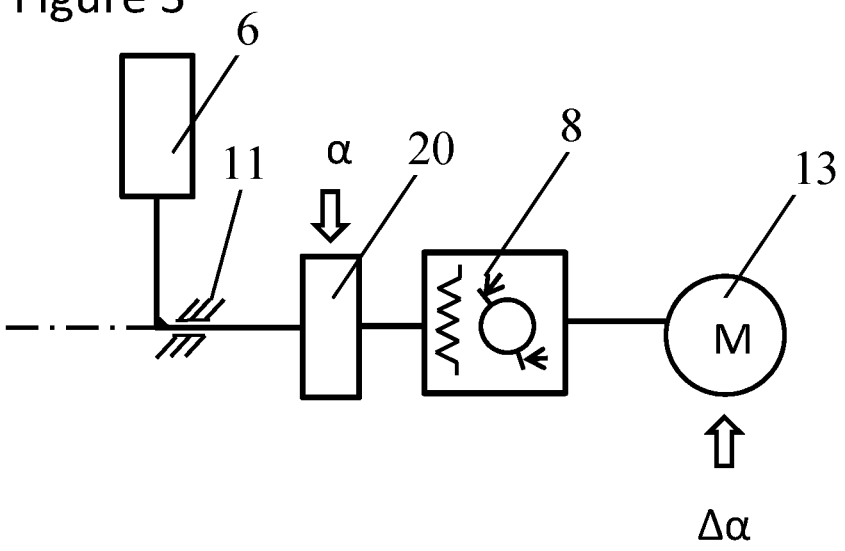
Figure 4:
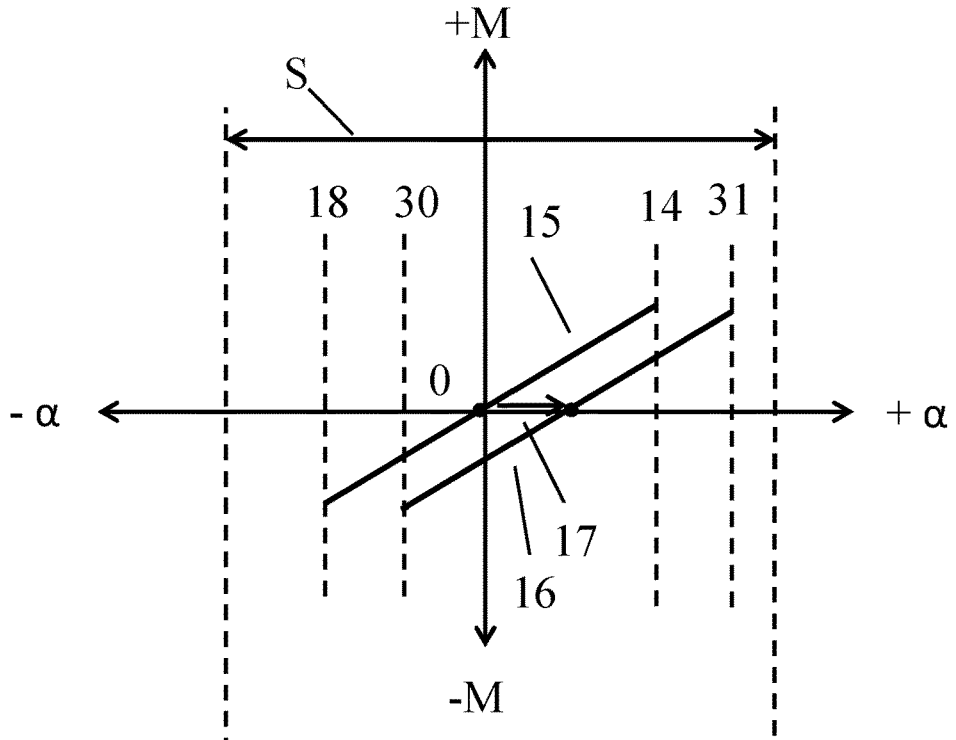
Figure 5:
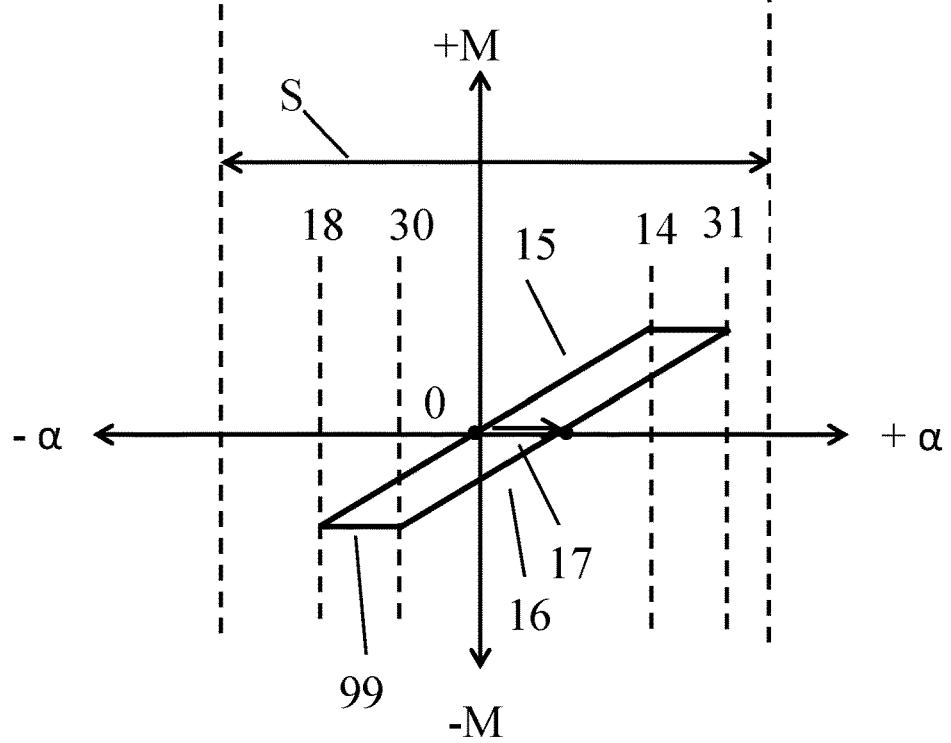
Figure 6:
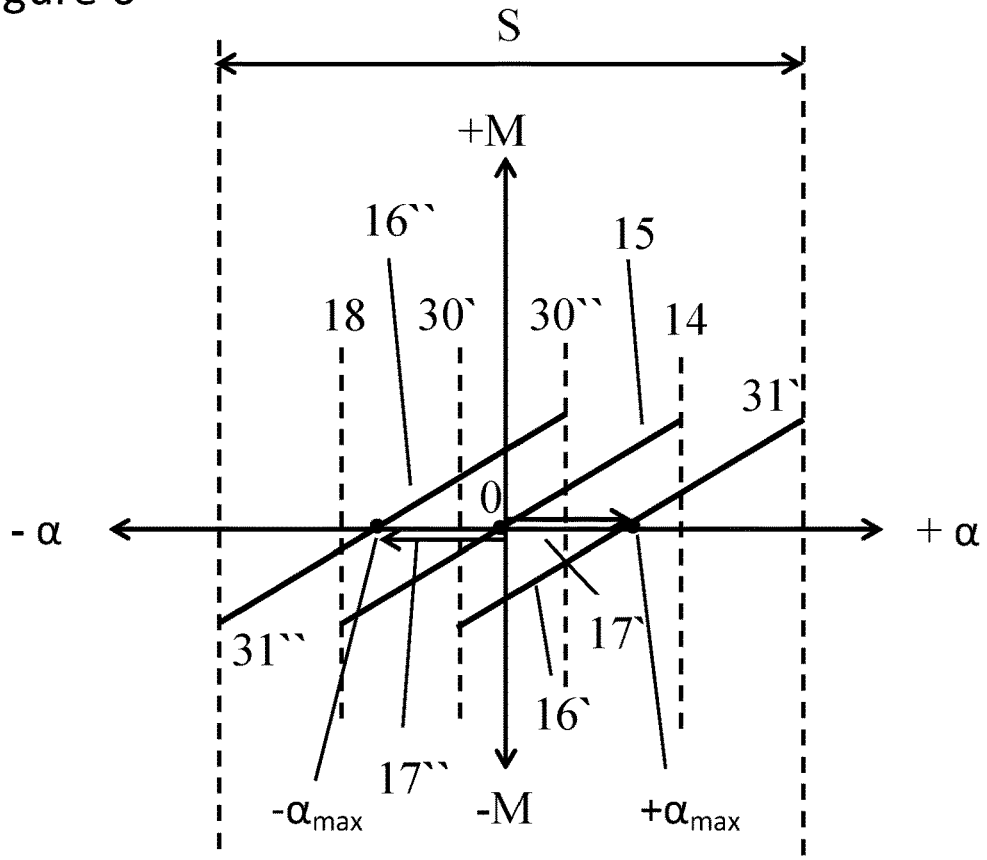
Figure 7:
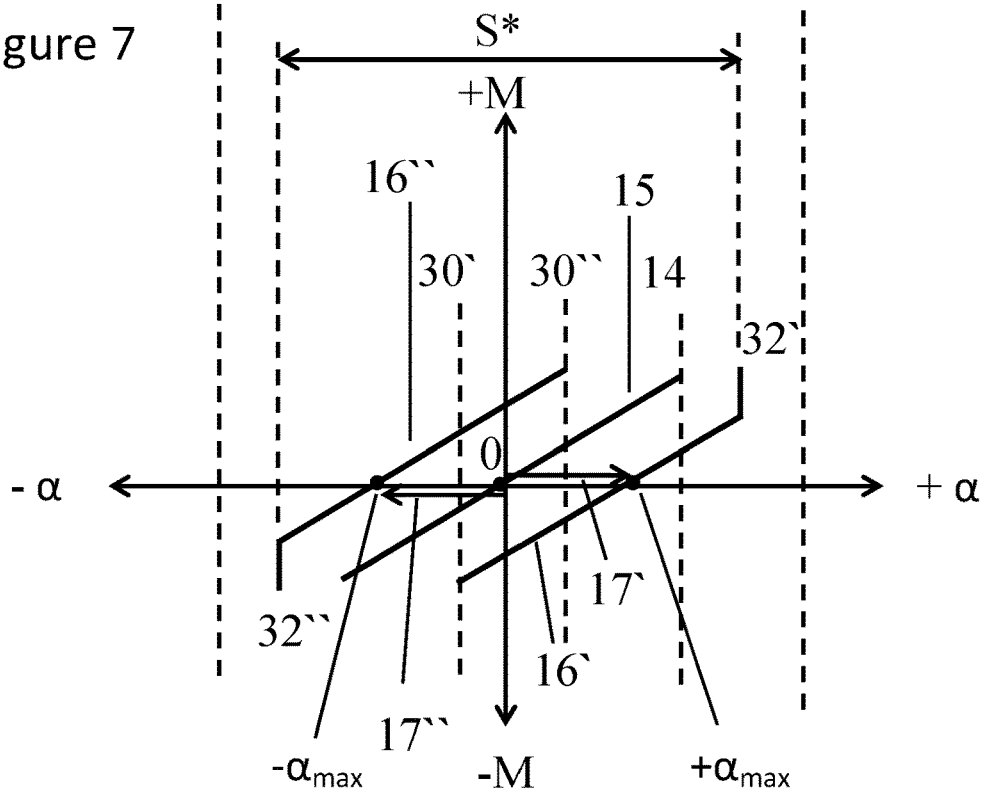

Further details and advantages of the invention will be explained in more detail with reference to an embodiment shown in the drawing. There are shown:

FIG. 1: a schematic view of the arrangement in accordance with the invention with a coupling:

FIG. 2: a schematic view of the arrangement in accordance with the invention with a brake, FIG. 3: a schematic view of the arrangement in accordance with the invention with a drive, FIGS. 4, 5: spring characteristics before and after a shifting of the spring assembly;

FIGS. 6, 7: spring characteristics on an absence of the tracking with a symmetrical and an asymmetrical deflection; and FIGS. 8 to 10: schematic views of arrangements of the prior art.

In FIGS. 1 to 3, the same parts or parts of the same function are provided with the same reference numerals as in FIGS. 8 to 10.

As can be seen from FIG. 1, a coupling 9 is located between the bearing point 10 and the spring assembly 8.

This coupling is open on the shifting of the spring assembly 8 by the user. If the spring assembly has adopted its desired position, the coupling 9 is closed so that the spring assembly 8 is fixed in the new destination central position.

FIG. 2 shows an arrangement corresponding to FIG. 1 with the only difference that the coupling 9 has been replaced with a brake 12. The function is the same as with the coupling to the extent that the brake 12 is open during the shifting of the spring assembly 8 and is closed on a reaching of the new destination central position.

The structure in accordance with FIG. 2 can also have two brakes, separately for each direction, each having a free-wheeling, so that the individual brake can in each case only act in one direction.

The brake 12 can for example, be a magnetic powder brake.

FIG. 3 shows a further embodiment in accordance with the invention. In this embodiment, the shifting of the spring assembly 8 is not passive, i.e. it does not take place by the manual actuation by the user, but rather by means of the motor 13. The latter is simultaneously designed such that it holds the spring assembly 8 in the new destination central position so that—as can be seen from FIG. 3—no brake or clutch elements are necessary. The motor 13 can be an electric motor that carries out the shifting movement of the spring assembly 8 via a transmission.

FIGS. 4 and 5 show on the ordinate the restoration torque that is applied to the manual control device by the spring assembly and on the abscissa the travel or the angle of rotation, etc. a of the manual control device. The lines 15 represent the spring/damping characteristic with a non-shifted spring assembly. In this case, the spring characteristic passes through the zero point of the coordinate system, i.e. when no excursion is present ($\alpha=0$), no restoring force acts on the manual control device. The springs of the spring assembly are designed such that on an excursion in both directions a restoring force acts such as can be seen in the line 15. Reference numerals 14 and 18 represent the abutments of the path excursion of the spring assembly. The abutments are here selected such that the travel of the manual control device is symmetrically bounded about the respective central position or zero point by the spring assembly.

In general, however, the case is also covered by the invention that the spring deflections correspond to the total sensor system measurement range that is indicated by the reference symbol S in FIGS. 4 and 5.

If the spring assembly is shifted a new spring characteristic results that is designated by way of example with reference numeral 16 in FIGS. 4 and 5. The characteristic shift is indicated by reference numeral 17. The new characteristic 16 again runs through the zero point; however, not at a zero travel of the manual control device, but rather with an already carried out travel $\alpha'$. On this travel $\alpha'$, the resulting restoring force on the manual control device is zero. A restoring force only results when the manual control device is traveled out of this new position.

New abutments 30 and 31 result after the shifting of the spring assembly.

Reference numeral 99 represents a region of constant torque.

The spring assembly can, as stated, consist of one or more springs. It is preferably configured such that a restoring force is generated in both or in all actuation directions of the manual control device.

The spring assembly can also have one or more damping or friction elements in addition to the spring or springs.

FIG. 6 shows a spring characteristic having a correction angle for the manual control device when the spring assembly adopts a maximum position+$\alpha$ max or $-\alpha$ max.

Reference is made to FIGS. 4 and 5 with respect to the characteristic 15 and to the limit values 14 and 18.

If now an erroneous actuation of the drive of the spring assembly occurs or any other erroneous adjustment of the spring assembly to the maximum positions +$\alpha$ max or $-\alpha$ max and if the spring assembly remains there, the steering capability of the work machine has to be maintained. To also enable a steering movement in both directions $\pm\alpha$ in these maximum positions $\alpha$ max or $-\alpha$ max, a correction angle is provided in this embodiment, i.e. the possibility of traveling the manual control device such as a joystick beyond this maximum position. A travel beyond the degree +$\alpha$ max or $-\alpha$ max bounding the tracking of the spring assembly is thus possible. The correction angle thus permits an excursion of the operating lever or of any other manual operating device (and thus a steering movement) by the degree of the spring excursion of the spring assembly beyond the maximum position +$\alpha$ max or $-\alpha$ max of the adjustment range of the spring assembly or of its drive.

FIG. 6 here shows an embodiment that enables a complete spring excursion at both sides against the torque M in accordance with the extents 16° and 16" at the two end abutments +$\alpha$ max and $-\alpha$ max of the tracking. The limit values of the adjustment range are 30' and 31' or 30" and 31" respectively. The shifting of the spring assembly is marked by 17' and 17" respectively.

It can be a disrupting effect in this embodiment that on the regular operation, i.e. on a problem-free reaching of the end abutments +$\alpha$ max or $-\alpha$ max in problem-free operation and on a corresponding reaching of the maximum steering movements at the vehicle, a residual deflection of +$\alpha$ max or $-\alpha$ max to 31' and 31" remains whose traveling over does not produce any further steering movement at the vehicle in problem-free operation.

It can be named as an advantage that the spring excursion or the correction angle, i.e. the travel of the manual control device of +$\alpha$ max to 31' or $-\alpha$ max to 31" in a disrupted operation of the tracking of the spring assembly is symmetrical within the sensor measurement range S.

A further embodiment variant is described in FIG. 7 in which the spring excursion and the correction angle to maintain the steering capability in disrupted operation is limited at both end abutments +$\alpha$ max and $-\alpha$ max to the dimensions 32' and 32".

The sensor rang to be installed is thus reduced to the dimension S*. In other respects, the embodiment corresponds to that of FIG. 6.

The variant in accordance with FIG. 7 has the advantage that the residual deflection of +$\alpha$ max or $-\alpha$ max to 32' to 32" is less than of +$\alpha$ max or $-\alpha$ max up to the respective other limit value 30' or 30" so that the travels of the manual control device that no longer result in any steering movement in problem-free operation can be kept small.

It must be named as a disadvantage that the user of the work machine in disrupted operation has to cope with an asymmetrical actuation characteristic since the degree of possible actuation of the manual control device is not of equal size in both directions.

The manual control device can, for example, be a joystick, an operating lever, a steering wheel, etc.

A system having a zero point shifting of the spring characteristic is preferably provided overall by the invention, with the zero point shifting being represented by a tracking of the spring assemblies or of the manual control device by the degree $\Delta\alpha$. This tracking preferably takes place in dependence on an associated actuator position, with the actuator preferably serving the adjustment of the steering angle of the work machine.

REFERENCE NUMERAL LIST

1 bearing point 1
2 bearing point 2
3 spring element 1
4 spring element 2
5 pivot point
6 manual control device or joystick in the starting position
7 manual control device or joystick, traveled
8 spring/damping element
9 clutch
10 bearing point 3
11 bearing point 4
12 brake
13 motor
14 abutment 1, first position
15 spring/damping characteristic 1
16 spring/damping characteristic 2
16' spring/damping characteristic 2
16" spring/damping characteristic 2
17 characteristic line shift
17' characteristic line shift
17" characteristic line shift
18 abutment 2, first position
20 sensor
30 abutment 2, second position
30' abutment 2, third and fifth positions
30" abutment 1, fourth and sixth positions
31 abutment 1, second position
31' abutment 1, third position
31" abutment 2, fourth position
32' abutment 1, fifth position
32" abutment 2, sixth position
$\alpha$ excursion angle, spring assembly
$\alpha'$ angle
$\Delta\alpha$ zero point shifting of the spring assembly within S
$+\alpha$ max, $-\alpha$ max: maximum excursion of the spring assembly
M motor
+M torque
−M torque
S sensor range
S* sensor range
99 range of constant torque

The invention claimed is:

1. An arrangement for controlling a work machine, comprising at least one manual control device, at least one restoring device in the form of one or more spring assemblies that is connected to the manual control device such that a restoring force is exerted on the manual control device by the spring assembly when the spring assembly is not in its central position, and at least one adjustment device that acts on the spring assembly such that a shifting of the central position of the spring assembly can be carried out by means of the adjustment device.

2. The arrangement in accordance with claim 1, further comprising at least one self-inhibiting transmission that is configured as a worm transmission located between the spring assembly and the adjustment device.

3. The arrangement in accordance with claim 1, characterized in that the adjustment device is configured such that a reference value for the shifting of the central position of the spring assembly is formed by the locational change of at least one part moved by the steering actuator of the work machine or by the locational change of the at least one steering actuator of the work machine itself.

4. The arrangement in accordance with claim 3, characterized in that the part is the steering geometry of the work machine.

5. The arrangement in accordance with claim 1, characterized in that the adjustment device is active or passive.

6. The arrangement in accordance with claim 1, characterized in that the adjustment device is passive, with the shifting of the central position of the spring assembly taking place by the manual actuation of the manual control device.

7. The arrangement in accordance with claim 1, characterized in that the adjustment device is active, with the shifting of the central position taking place by at least one adjustment drive.

8. The arrangement in accordance with claim 7, characterized in that the adjustment drive is configured to fix the spring assembly in the shifted position.

9. The arrangement in accordance with claim 1, characterized in that the arrangement has at least one brake, or at least one coupling that is configured to fix the spring assembly in the shifted position, or both.

10. The arrangement in accordance with claim 1, characterized in that at least one sensor is present that detects the position of the manual control device or a value based thereon.

11. The arrangement in accordance with claim 10, characterized in that the deflections of the spring assembly comprise the total measurement range of the sensor or only a part thereof; or in that the deflections of the spring assembly are provided with one or more abutments, with the abutments being selected such that the travel of the manual control device is possible symmetrical to both abutments, starting from the central position.

12. The arrangement in accordance with claim 1, characterized in that the spring assembly has one or more springs and optionally one or more dampers and/or friction elements.

13. The arrangement in accordance with claim 1, characterized in that the adjustment means are configured such that the shifting of the central position of the spring assembly is possible up to at least one maximum position; and in that the spring assembly is configured such that on a reaching of a maximum position of the spring assembly, an adjustment of the manual control device beyond it is possible by the user of the work machine.

14. The arrangement in accordance with claim 13, characterized in that the spring assembly is configured such that the adjustment of the manual control device on reaching a maximum position of the spring assembly is symmetrical relative to its central position.

15. The arrangement in accordance with claim 13, characterized in that the spring assembly is configured such that the adjustment of the manual control device on a reaching of a maximum position of the spring assembly is asymmetrical relative to its central position, with the adjustment path beyond the maximum position being smaller than in the opposite direction.

16. The arrangement in accordance with claim 13, characterized in that the arrangement is configured such that the adjustment of the manual control device is only possible within a sensor range of the arrangement.

17. A work machine having at least one arrangement in accordance with claim 1.

18. The arrangement of claim 1, wherein said work machine is a wheeled loader, having the at least one manual control device.

19. The arrangement of claim 1, wherein the at least one manual control device is a joystick or a steering wheel.

20. The arrangement in accordance with claim 1, wherein the adjustment device is active, with the shifting of the central position taking place by at least one motor.

* * * * *